US007040588B2

(12) United States Patent
Lowe

(10) Patent No.: US 7,040,588 B2
(45) Date of Patent: May 9, 2006

(54) ANCHOR ASSEMBLY

(75) Inventor: Gregory E. Lowe, Berthoud, CO (US)

(73) Assignee: Omega Pacific, Inc., Spokane, WA (US)

( * ) Notice: Subject to any disclaimer, the term of this patent is extended or adjusted under 35 U.S.C. 154(b) by 176 days.

(21) Appl. No.: 10/712,161

(22) Filed: Nov. 12, 2003

(65) Prior Publication Data

US 2005/0098696 A1 May 12, 2005

(51) Int. Cl.
*A47F 5/08* (2006.01)

(52) U.S. Cl. ..... 248/231.9; 182/9; 248/925

(58) Field of Classification Search ..... 248/231.9, 248/925, 231.21, 231.31, 231.85; 182/5, 182/6, 9

See application file for complete search history.

(56) References Cited

U.S. PATENT DOCUMENTS

| | | | | |
|---|---|---|---|---|
| 4,184,657 | A | 1/1980 | Jardine | |
| 4,565,342 | A | 1/1986 | Grow | |
| 4,575,032 | A | 3/1986 | Taylor | |
| 4,586,686 | A | 5/1986 | Cason | |
| 4,643,377 | A | 2/1987 | Christianson | |
| 4,645,149 | A | 2/1987 | Lowe | |
| 4,712,754 | A | 12/1987 | Brodie | |
| 4,781,346 | A | 11/1988 | Banner | |
| 4,832,289 | A | 5/1989 | Waggoner | |
| 4,923,160 | A | 5/1990 | Waggoner | |
| 5,860,629 | A | 1/1999 | Reed | |
| 6,042,069 | A | 3/2000 | Christianson | |
| 6,375,139 | B1 | 4/2002 | Murray et al. | |
| 6,679,466 | B1 * | 1/2004 | Brown | 248/231.9 |
| 6,736,359 | B1 * | 5/2004 | Murray | 248/231.9 |
| 2002/0162927 | A1 | 11/2002 | Brown | |
| 2003/0057337 | A1 | 3/2003 | Brown | |
| 2005/0098696 | A1 * | 5/2005 | Lowe | 248/231.9 |

FOREIGN PATENT DOCUMENTS

DE 3717027 A1 * 12/1988

* cited by examiner

*Primary Examiner*—Anita King
*Assistant Examiner*—Tan Le
(74) *Attorney, Agent, or Firm*—Wells St. John P.S.

(57) ABSTRACT

An anchor assembly is described and which includes a plurality of individual article engaging portions, each having opposite first and second ends, and wherein the individual portions are pivotally mounted at the opposite ends thereof to the adjacent portion, and wherein the individual portions are moveable along a course of travel between a first non-deployed position where the plurality of individual portions cause the anchor assembly to have a first dimension, and a second deployed position where the individual portions cause the anchor assembly to have a second dimension which is greater than the first dimension.

13 Claims, 5 Drawing Sheets

ANCHOR ASSEMBLY

TECHNICAL FIELD

The present invention relates to an anchor assembly, and more specifically to an anchor assembly which employs a plurality of rotatable camming elements or members each of which includes a plurality of individual article engaging portions which are rotatable, one relative to the other.

BACKGROUND OF THE INVENTION

The sport of rock climbing has expanded significantly since the early 1970's with the introduction of various pieces of passive protection which can be placed into the cracks of a rock face and which permit climbers to safely ascend a rock face without defacing or destroying the rock face. As should be understood, in the sport of rock climbing, climbers typically rely on dynamic ropes to advance up a rock face. These particular ropes protect them against falls and allow them to move their climbing gear along a pitch as they climb. These ropes which secure the climber and/or gear of the climber are removably secured to the rocks through the use of various anchoring devices or what is termed above "passive protection." These various anchoring devices are operable to be coupled with carabineers, webbing straps, and other devices in order to assist the climb. Anchoring devices have heretofore been of two types, those which are permanently emplaced or fixed on the rock face, and those that are removable.

In recent times, fixed anchoring apparatus or devices such as pitons and hangers of various types have become disfavored in many popular rock climbing sites. As a general matter, these have become disfavored because of the damage done to the rock face when placing these devices. Still further, these devices often project dangerously from the rock face, they rust, and they can often break off and leave sharp remnants. Still further, pitons for example have become disfavored because they are quite heavy and they are often cannot be removed once they have been placed, thus necessitating a costly replacement. In addition to the foregoing, severe accidents have occurred in the past when later climbers have relied upon previously placed pitons only to discover that they cannot sustain a dynamic fall. Moreover, the placement of pitons in rock faces which experience high erosion have caused cracks or fissures to develop in the rock faces.

Because of the many perceived disadvantages of fixed anchors (pitons and hangers) and the trend toward clean climbing, various readily deployable and removable anchors have been developed. The prior art is replete with numerous examples of active and passive chocks and removable anchors. In this regard, active chocks have one or more moving parts while passive chocks have no moving parts. Chocks which are commonly called "nuts" are used by forcing them into a crack. These devices then act in a tortional fashion in the crack. Still further, various anchors having a plurality of spring biased camming elements have been developed and which are operable to be placed in a crack of a rock and which, when expanded, can resist the fall of a climber.

Examples of various spring loaded camming devices of this type are exemplified by the following U.S. Pat. Nos.: 4,184,657; 4,781,346; 4,645,149; 4,643,377; 4,586,686; 4,565,342; 4,575,032; 4,712,754; 4,832,289; 4,923,160; 5,860,629; 6,042,069; 6,375,139; and U.S. Published applications: 2002/0162927 and 2003/0057337. The teachings of these references are incorporated by reference herein.

In use, the prior art devices, as described above, are, typically anchored in natural cracks or crevices formed in a rock wall. These cracks of course are of widely varying shapes and sizes. In order to allow secure placement of a camming device of these designs, it is advantageous to have a camming head or portion which is not only adjustable to fit the cracks of varying widths, but which is otherwise as axially compact as possible. More specifically, the compactness of such devices allows its use in some difficult crack placements where prior art devices sized to fit cracks of similar widths might not be useable. Such difficult placements typically include cracks which are not straight, or which have other abnormalities which create difficulty in placing the spring loaded camming assembly in an appropriate location where it might withstand a load which is generated by a subsequent fall of a climber.

One of the typical difficulties in placing such pieces of protection relates to selecting the appropriate sized spring loaded climbing anchor for placement in cracks that have varying width. In view of the difficulties in selecting appropriate anchors, a rock climber will typically carry a range of different anchors having various sizes to fit into cracks of various widths. These several additional anchors increases the weight of the rack which the climber must carry and further increases the difficulty in selecting the appropriate anchor to fit the crack being considered. In view of the difficulty in selecting an appropriate anchor, a climber may attempt to place several differently sized anchors in the crack before finally selecting an appropriate one. Beyond the difficulty associated with carrying additional anchors, the handling and attempted placement, and then replacement of the anchor back on to climbers climbing harness or rack results in expenditure of additional time, and an increased likelihood that the anchor will be mishandled or otherwise dropped before it is reattached to the climber's body.

Therefore, the present invention relates to a climbing anchor having improved performance characteristics and which further addresses many of the perceived shortcomings attendant with the prior art climbing anchors of similar design.

SUMMARY OF THE INVENTION

Therefore, one aspect of the present invention is to provide an anchor assembly which may be utilized in the sport of rock climbing.

Another aspect of the present invention relates to an anchor assembly which includes a plurality of individual article engaging portions, each having opposite first and second ends, and wherein the individual portions are pivotally mounted, at the opposite ends thereof, to the adjacent portion, and wherein the individual portions are moveable along a course of travel between a first non-deployed position where the plurality of individual portions cause the anchor assembly to have a first dimension, and a second deployed position wherein the individual portions cause the anchor assembly to have a second dimension, which is greater than the first dimension.

Another aspect of the present invention relates to an anchor assembly which includes a support member having a first end, and an opposite second end; a first article engaging portion having a first end which is rotatably mounted on the second end of the support member, and an opposite second end; and a second article engaging portion having a first end which is pivotally mounted on the second end of the first article engaging member, and an opposite second end, and wherein the respective article engaging portions each have an outwardly facing, and an inwardly facing peripheral edge, and wherein the individual portions are moveable between a first position, wherein the individual outwardly facing peripheral edges of the individual portions define substantially discrete arcuately shaped surfaces, and the inwardly facing peripheral edges are disposed in spaced relation, one relative to the other, and a second position, wherein the outwardly facing peripheral edges of the individual article engaging portions define a substantially continuous arcuately shaped surface, and the inwardly facing peripheral edges of the respective article engaging portions lie in juxtaposed force transmitting relation, one relative to another.

Yet another aspect of the present invention relates to an anchor assembly, which includes a support member having opposite first and second ends; a first article engaging portion having a first end which is rotatably mounted on the second end of the support member, and wherein the first member rotates in a first, and an opposite, second direction; a biasing member borne on the second end of the support member and which forceably acts upon the first article engaging portion to cause the first article engaging portion to rotate in the first direction; a second article engaging portion having a first end, which is pivotally mounted to the second end of the first article engaging portion, and an opposite second end; a third article engaging portion having a first end which is pivotally mounted to the second end of the second article engaging portion and an opposite second end; a linkage having a first end which is mounted on the third article engaging portion, and further having an opposite second end; and a force application assembly slideably cooperating with the support member, and wherein the second end of the linkage is mounted on the force application assembly, and wherein the application of force to the force application assembly has the effect of moving the first, second and third article engaging portions along a course of travel between a deployed position, and a non-deployed position, and wherein the application of force further causes the first article engaging portion to rotate in the second direction, and wherein the removal of the force applied to the force application assembly permits the biasing assembly to rotate the first article engaging portion in the first direction.

These and other aspects of the present invention will be discussed in greater detail hereinafter.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
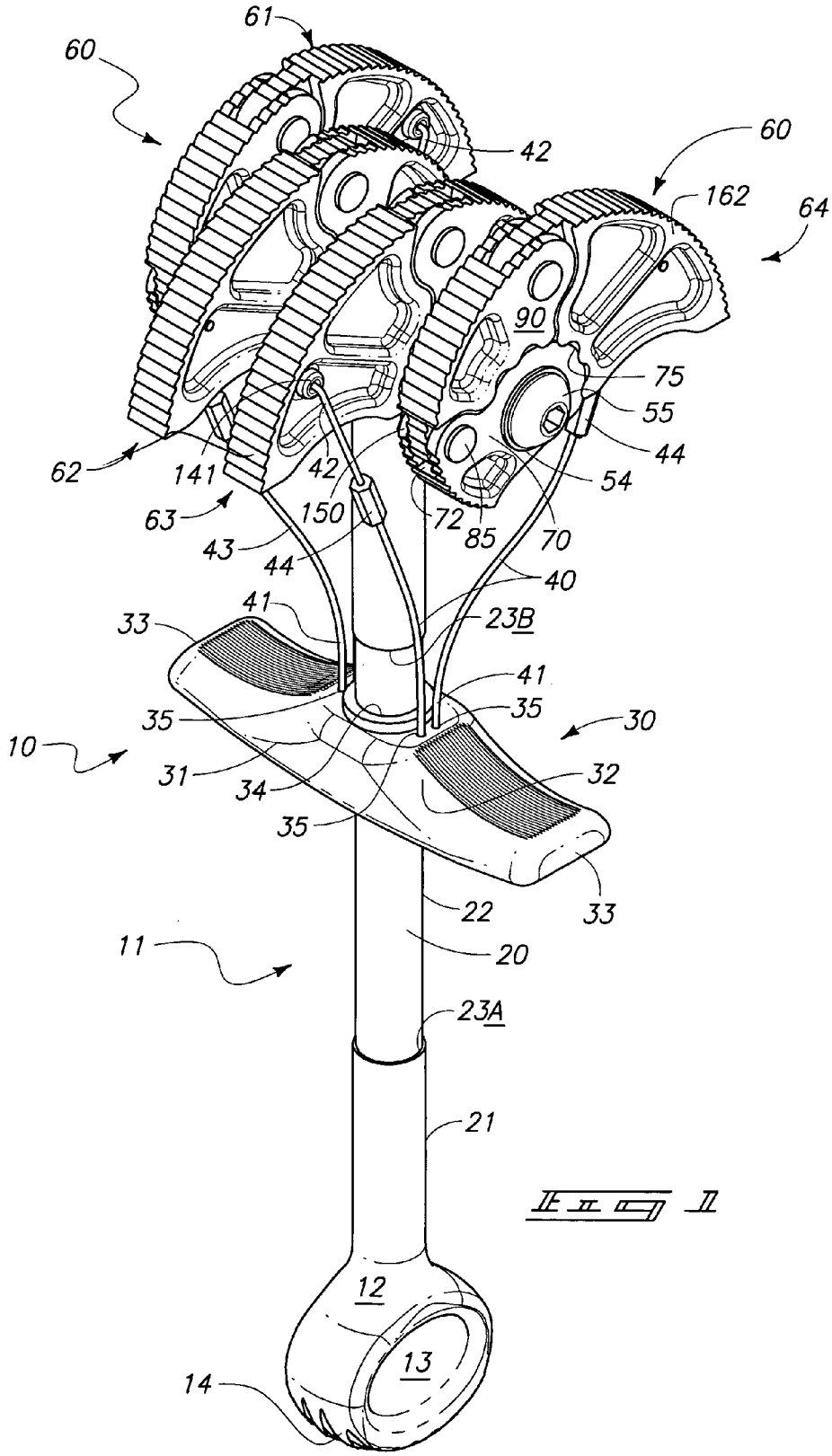
FIG. 1 is a perspective side elevation view of the anchor assembly of the present invention and which is shown in a deployed position.
Figure 2:
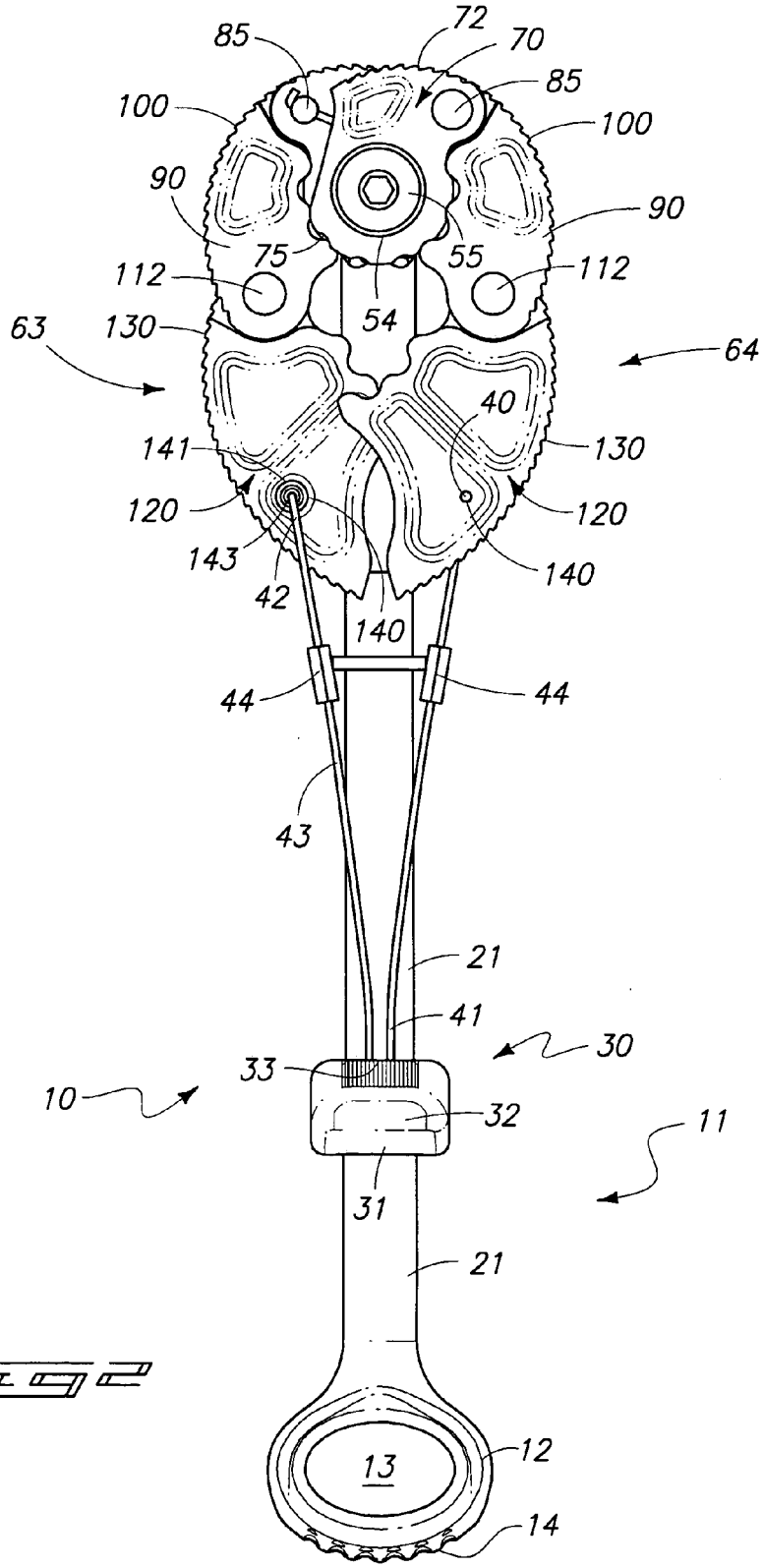
FIG. 2 is a side elevation view of the anchor assembly of the present invention and which is shown in a partially deployed position.

The anchor assembly of the present invention is generally indicated by the numeral 10 in FIG. 1 and following. As best seen by reference to the drawings, the anchor assembly 10 includes an elongated support member 11 which has a first, somewhat enlarged, end 12 and which has formed therein an aperture 13 which will accept a carabineer (not shown). The first end 12 of the support member 11 is operable to be coupled by means of a carabineer (not shown) and associated webbing, to a climber or other load to be supported. The somewhat enlarged first end is operable to be placed in the palm of the climber's hand and held in such a fashion so that the anchor assembly 10 may be manually manipulated to place it in an appropriate position within a crack of a rock face. As illustrated in FIGS. 1 and 2 for example, the first somewhat enlarged end 12 has an irregular or roughened surface 14 formed in the outer facing portion thereof. This irregular surface provides increased friction in the palm of the climber's hand thereby making the anchor assembly easier to manually manipulate. The elongated support member 11 further has a second end which is generally indicated by the numeral 15 and which is best seen by reference to FIG. 3. The second end 12 has an aperture form therein (not shown) and which is operable to receive an axel member which will be discussed in greater detail hereinafter. Located between the first end 12, and the opposite, second end 13 is an intermediate portion, which is generally indicated by the numeral 20. The intermediate portion includes a first region 21 having a first diametral dimension, and which extends from the first end towards the second end. Still further, the intermediate portion 20, includes a second region 22 which has a second diametral dimension which is smaller than the first diametral dimension. A step 23 A and B is defined between the first and second regions. This is seen most clearly by reference to FIG. 1. As should be understood, while the intermediate portion of the elongated support member 11 is illustrated herein as being substantially circular in cross-section, it should be understood that other cross-sectional shapes would work with equal success. Those skilled in the art will also recognize that the elongated support member 11 may be fabricated from different materials including metal, and other synthetic or composite compositions. The selected material, however, would need to forcibly withstand a load applied to the first end 12 such as might be experienced when a rock climber takes a fall during a typical climb. It will be further recognized that the support member may be fabricated as an integral assembly, or further fabricated with several pieces which are joined or otherwise coupled together to form the support member 11.

The anchor assembly 10 of the present invention includes a force application assembly 30 which slideably cooperates or is otherwise mounted for movement along the intermediate portion 20 thereof, and between the first end 12 and the opposite second end 15. This is best seen by a comparison of FIGS. 4 and 5, respectively. The force application assembly 30 includes a hand manipulatable toggle member 31 having a main body 32 which has opposite ends 33. The opposite ends can be conveniently engaged by the fingers of the climber while the first end 12 rests in the palm of the climber's hand. The main body 32 of the hand manipulatable toggle member 31 has a centrally disposed passageway 34 formed therein, and which matingly and telescopingly receives the intermediate portion 20 of the elongated support member 11 therein. Still further, linkage receiving passageways 35 (FIG. 3) are formed in the main body 32 and are positioned in a location intermediate the opposite ends 33. These linkage receiving passageways 35 are operable to receive a linkage which is generally indicated by the numeral 40. This linkage will typically comprise a flexible metal cable having an appropriate tensile strength. The linkage 40 has a first end 41 which is fastened in an appropriate fashion to the force application assembly 30, and an opposite second end 42 which is coupled in force transmitting relation relative to one of the article engaging portions which will be discussed in greater detail hereinafter. Still further, the linkage includes an intermediate portion 43 which is located between the first and second ends 41 and 42. While the present linkage is discussed in terms of having opposite first and second ends, it should be understood that the linkage may be made continuous, that is, threaded through the linkage receiving passageways 35 such that the opposite ends of the linkage are attached to appropriate article engaging portions that will be discussed hereinafter. As seen in the drawings, the linkage may comprise one or more portions which may be joined together by means of a cable swage 44. In this arrangement, the portion which is looped or otherwise received through the passageways 35 would constitute the second end 42 of the linkage. As will be appreciated by a study of FIGS. 3 and 4, the application of force by the climber's fingers on the manipulatable toggle member 31 has the effect of moving the toggle member in the direction of the first end 12. The force applied by the climber's fingers to the toggle member will be transmitted along the linkage 40 for the purposes which will be described below.

Figure 3:
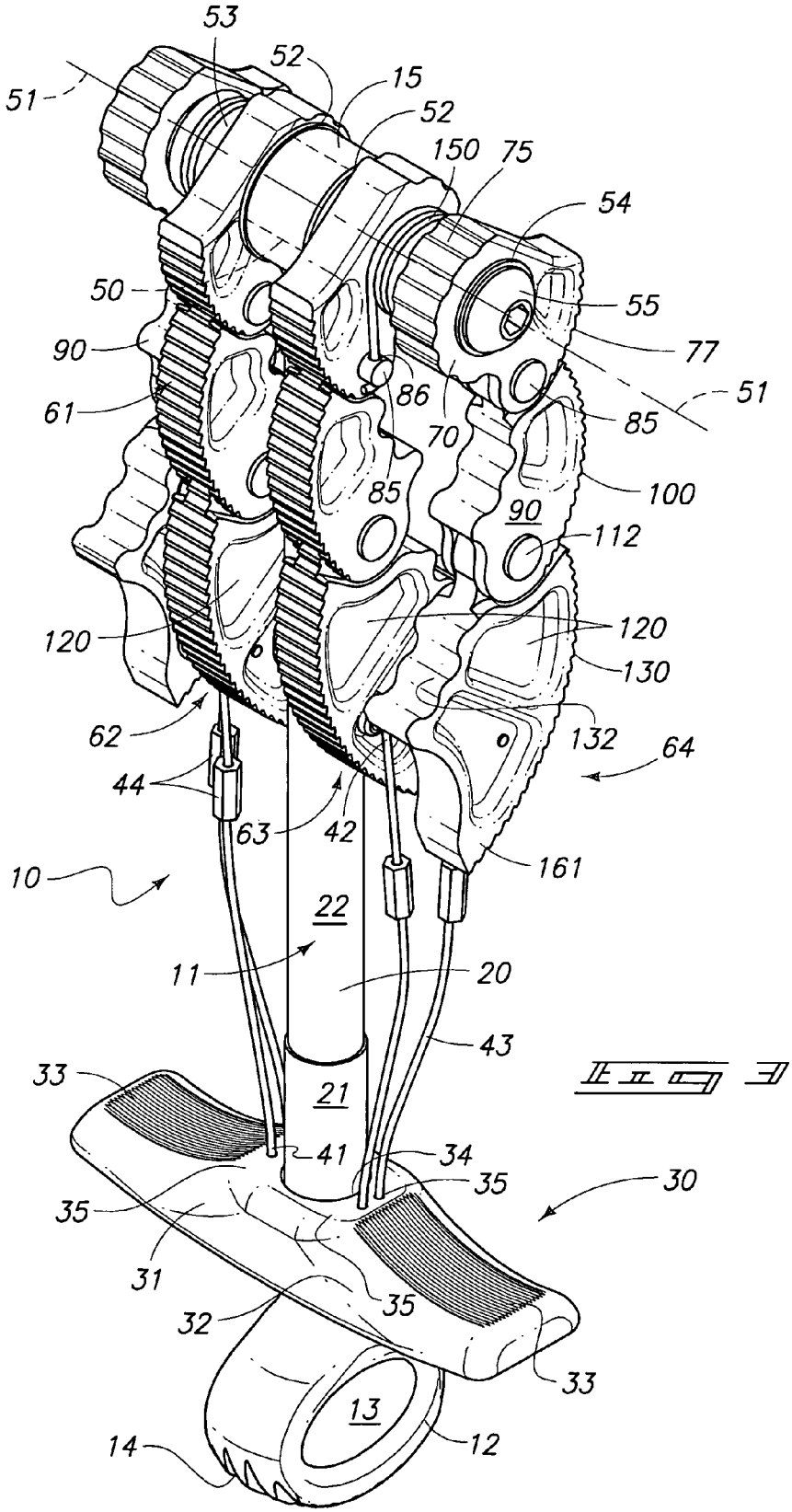
FIG. 3 is a perspective side elevation view of the anchor assembly of the present invention and which is shown in a non-deployed position.

Referring now to FIG. 3, it should be understood that the anchor assembly 10 of the present invention includes an axel member which is generally indicated by the numeral 50 and which is borne by the second end 15 of the support member 11. The axel member, which is illustrated in phantom lines, is received through an aperture formed in the second end of the support member (not shown). In this position, the axel member is disposed in substantially normal relation relative to the support member 11. The axel member 50 defines an axis of rotation which is generally indicated by the line labeled 51. The portions of the axel member 50 which extend outwardly relative to the second end 15 are individually operable to receive a thrust bearing 52 thereabout and which rests in contact with the opposite sides of the support member 11 at the second end 15. As seen, the axel member 50 extends normally outwardly in opposite directions relative to the second end 15. Positioned outwardly and coaxially along the axel member are individual cam bearings 53. These respective cam bearings 53 are operable to matingly and mechanically cooperate with the first article engaging portions as will be discussed in greater detail hereinafter. Still further, and received on the opposite ends of the axel member 50 are axel end caps 54. Individual threaded fasteners 55 are operable to engage each end of the axel member 50 and are operable to secure the camming elements, which will be described below, in an appropriate relationship relative to the axel member 50.

A plurality of camming elements or lobes which are generally indicated by the numeral 60 (FIG. 1) are positioned in predetermined spaced relationship therealong the axel member 50. The plurality of camming elements or lobes include a first, second, third and fourth camming elements 61–64, respectively. As seen in the drawings, it will be recognized that each of the camming elements or lobes are operable for rotational movement about the axel member 50, and the axis of rotation 51. In operation, and as will be discussed in more detail below, pairs of the camming elements or lobes 60 are operable for counter-rotation one relative to the other. These features will be described in greater detail hereinafter.

In the paragraphs which follow, an individual camming element or lobe 60 having a plurality of portions will be discussed in detail. It should be understood that the description regarding this single camming element or lobe will apply to each of the camming elements or lobes 60 as depicted in the drawings.

Figure 6:
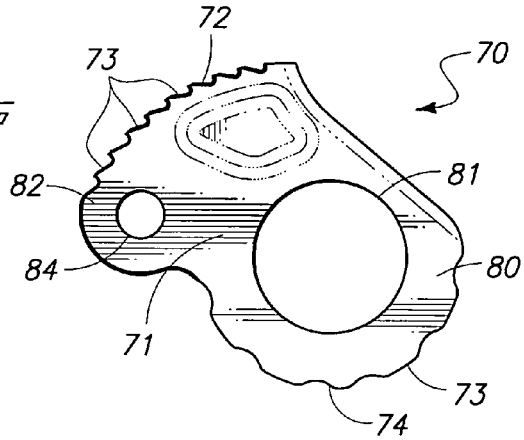
FIG. 6 is a fragmentary, side elevation view of a first article engaging portion utilized with the anchor assembly of the present invention.

Referring now to FIG. 6, it should be understood that each of the camming elements 60 include a first article engaging portion or member which is generally indicated by the numeral 70. As seen in FIG. 6, the first article engaging portion which comprises a portion of the respective camming elements, or camming lobes 60, has a main body 71 which is defined in part by an outside facing, generally arcuately shaped peripheral edge 72. As seen in FIG. 6, the outwardly facing peripheral edge has a plurality of serrations 73 formed therein. The function of these serrations is to frictionally engage the article adjacent thereto such as the rock face forming a crack (not shown) in which the anchor assembly 10 is being positioned. The main body 71 further has an inside peripheral edge which is generally indicated by the numeral 74. The inside peripheral edge 74 defines a plurality of undulations, the function of which will be discussed in greater detail hereinafter. The main body 71 further has a first end 80, which has an axel receiving aperture 81 formed therein. As should be understood, the first article engaging portion is operable for rotational movement thereabout the axel member 50. Still further, the main body 71 has an opposite second end 82 which has an aperture 84 formed therein. Still further, the aperture 84 is formed adjacent to the outside peripheral edge 72 and is operable to receive a rivet, fastener, or first shaft 85 (FIG. 1) therein, and which provides a rotatable coupling between the first article engaging portion or member and a second article engaging member or portion as will be discussed in further detail below. The first shaft has a passageway 86 formed therein and which is operable to receive a biasing member which will be discussed below.

Figure 7:
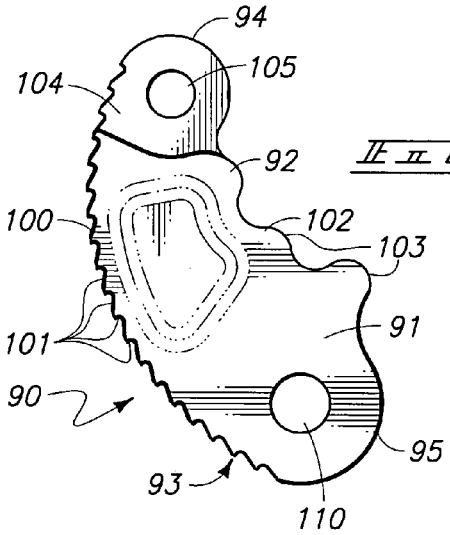
FIG. 7 is a fragmentary, side elevation view of a second article engaging portion utilized with the anchor assembly of the present invention.

Referring now to FIG. 7, a second article engaging member or portion 90 is rotatably coupled to the first article engaging member 70 by way of the first rivet or shaft 85 which is received in the aperture 84 that is formed in the first article engaging portion 70. The second article engaging member or portion 90 has a main body 91 which has opposite first and second sides 92 and 93 respectively. Still further the main body 91 has opposite first and second ends 94 and 95, respectively. As will be seen from the drawings, the first end 94 of the second article engaging member is rotatably coupled to the second end 82 of the first article engaging member. The main body 91 further has a substantially arcuately shaped outwardly facing peripheral edge 100 which has a plurality of serrations 101 formed therein. The serrations 101 operate in a fashion similar to that described with respect to the first article engaging portion 70. Still further, the main body 91 has an inside facing peripheral edge 102 which has a plurality of undulations 103 formed therein. As will be recognized from the drawings, the undulations 103 are operable to matingly and mechanically cooperate with the undulations 75 which are formed on the inside peripheral edge 74 of the first article engaging portion 70 as will be described below.

As seen in FIG. 7, a movement limiting area 104 is formed in the first side 92 of the main body 91 at the first end 94. This movement limiting area which is formed in the first end 94 provides a limited range of rotation for the second article engaging member or portion 90 relative to the first article engaging member or portion 70. In addition to the foregoing, a second aperture 110 is formed in the second end 95, and is operable to receive a second rivet, fastener, or shaft 112 (FIG. 4) which permits the second article engaging member 90 to be rotatably coupled to an adjacent third article engaging member or portion as will be described below.

Figure 8:
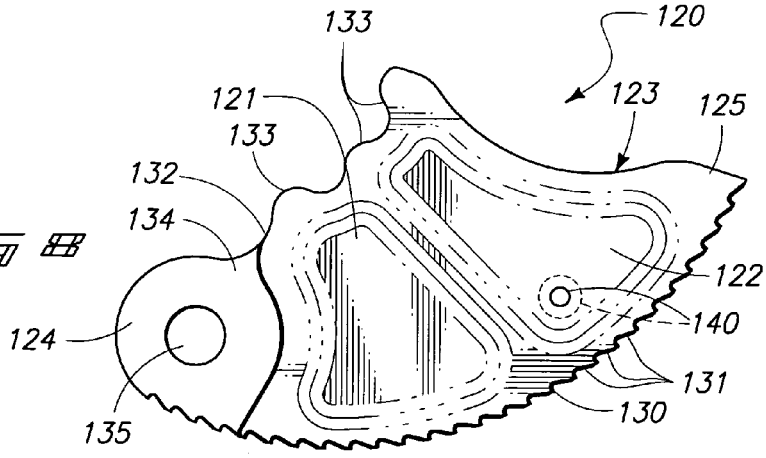
FIG. 8 is a fragmentary, side elevation view of a third article engaging portion utilized with the anchor assembly of the present invention.

Referring now to FIG. 8, each of the camming elements or lobes 60 include a third article engaging portion 120 which is rotatably affixed to the second article engaging portion 90 at the second end 95 thereof. In this regard, the third article engaging portion 120 has a main body 121 that has opposite first and second sides 122 and 123, respectively. Still further, the main body has a first end 124, and an opposite second end 125. The main body 121 includes a generally arcuately shaped peripheral edge 130. A plurality of serrations 131 are formed along the outside facing arcuately shaped peripheral edge. These serrations operate in a fashion similar to that which was described with respect to the first article engaging portion 70 which was discussed above. Still further, the main body 121 is defined in part by an inside peripheral edge 132. The inside peripheral edge has a plurality of undulations 133 which are operable to matingly and mechanically cooperate with the undulations 75 that are defined along the inside peripheral edge 74 of the first article engaging portion 70. The function of this mating cooperation will be discussed below. A movement limiting area 134 is formed in the first side 122 of the main body at the first end 124 thereof. The movement limiting area functions in a fashion similar to the movement limiting area 104 which is formed in the second article engaging member or portion 90, that is, the movement limiting area 134 defines a limited range of rotational movement of the third article engaging member or portion 120 relative to the second article engaging member or portion 90. A first aperture 135 is formed in the movement limiting area 134 at the first end 124 of the main body 121. Still further, a second aperture 140 is formed at the second end 125 thereof. The second aperture is operable to receive and secure the linkage 40. This is best illustrated in FIG. 2. As seen in FIGS. 1 and 2, a coupler 141 rotatably affixes the second end 42 of the linkage 40 in the second aperture 140.

Figure 5:
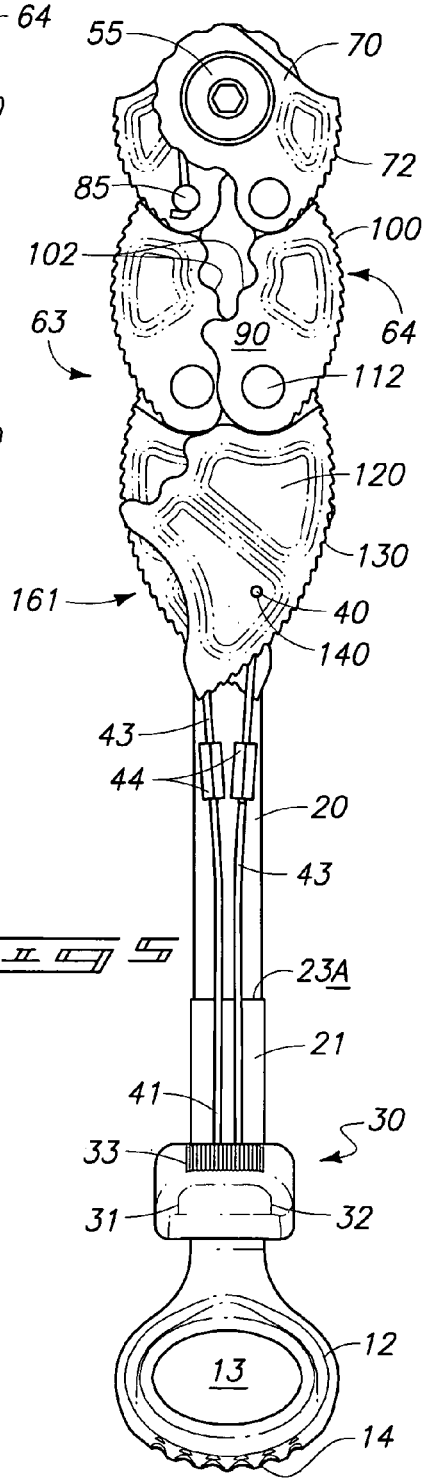
FIG. 5 is a side elevation view of the anchor assembly of the present invention and which is shown in a non-deployed position.

Referring now to FIG. 5, and as discussed earlier, the linkage 40 has a first end 41 which is coupled to the force application assembly 30. Still further, the second end 42 is received and otherwise secured within the second aperture 140 which is formed in the third article engaging portion 120 (FIG. 8) by way of the coupler 141. As discussed earlier, the linkage 40 is operable to transmit force applied by the climber's hand to the hand manipulatable toggle member 31 when the toggle member is grasped and pulled in the direction of the first end 12 of the support member 11. This force is applied by way of the linkage 40 to the third article engaging portion.

Referring now to FIG. 3, a biasing member, which is generally indicated by the numeral 150, is received about the axel member 50. The biasing member cooperates with the axle 50 and has a first end 151 which is received or otherwise affixed in the passageway 86 which is formed in the first shaft 85 (FIG. 3), and a second end (not shown) which is received in the same passageway formed in the shaft 85 of the immediately adjacent article engaging portion 60 which is made integral with the adjacent camming lobe 60. As will be recognized, therefore, a single biasing member 150 is positioned between two adjacent camming elements or lobes 60 and is operable to influence same.

Figure 4:
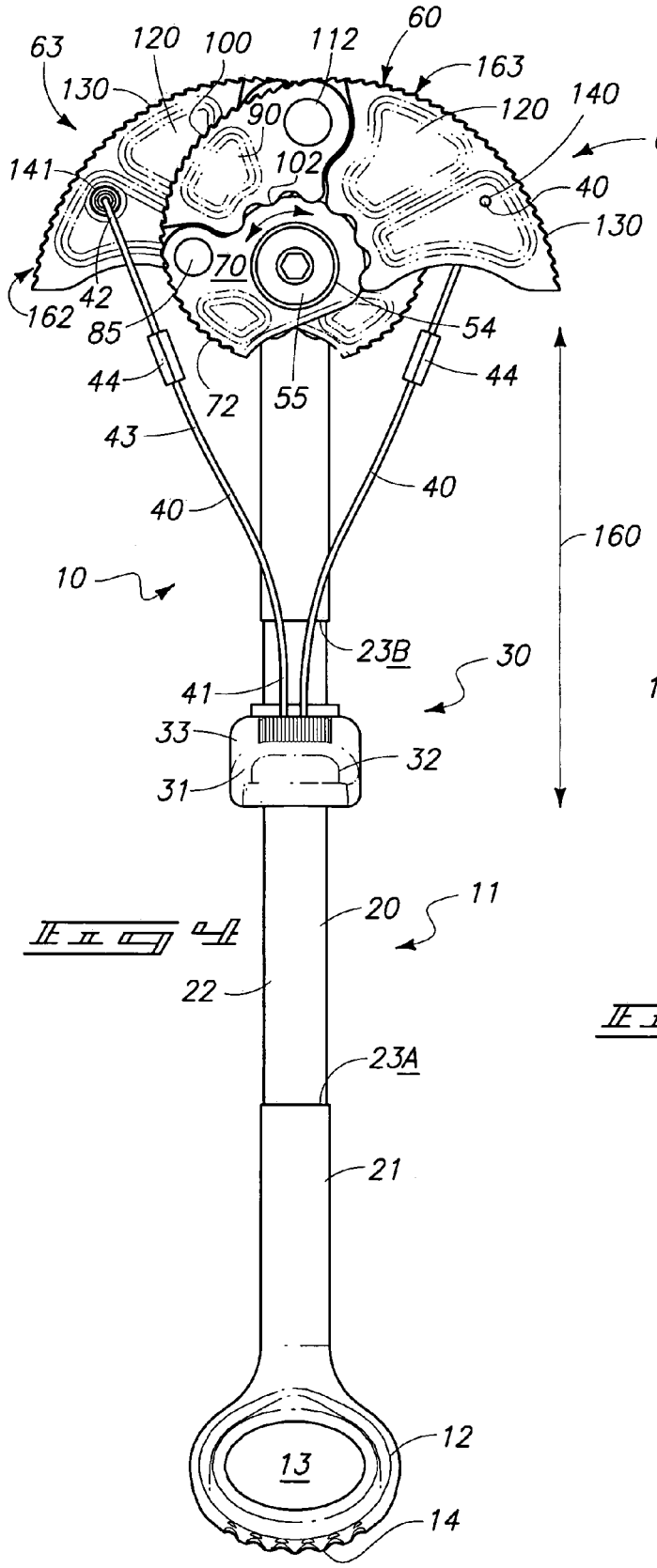
FIG. 4 is a side elevation view of the anchor assembly of the present invention and which is shown in a deployed position.

As will be best understood by a study of FIGS. 2, 3 and 4, the individual article engaging portions 70, 90 and 120 are moveable along a course of travel 160 between a first non-deployed position 161 (FIG. 5) wherein the plurality of individual camming lobes 60 cause the anchor assembly 10 to have a first dimension; and a second deployed position 162 (FIG. 4) where the individual portions or camming lobes 60 cause the anchor assembly 10 to have a second dimension which is greater than the first dimension. As will be recognized by a study of FIG. 5, the arrangement of the present invention 10 permits the first dimension to be narrower than what might be provided by the prior art teachings. Therefore, the present invention can be inserted in a non-deployed position 161 into cracks formed in a rock wall (not shown) and which are of narrower dimensions than what might be possible utilizing the prior art devices. Still further, the anchor assembly 10 when disposed in the deployed position 162 is operable to engage the adjacent rock face forming the crack to resist a load imparted to same as may be occasioned by the fall of a climber. As will be understood by a study of FIG. 4, it will be seen that the undulating inside peripheral edges 74, 103 and 133 of the respective article engaging portions 70, 90, and 120 matingly and mechanically cooperate together in such a fashion that when a load is applied to the first end 12 of the support member 11, that that same force is transmitted by way of the second and third article engaging portions 90 and 120 in an efficient fashion to the first article engaging portion. This permits the load to be transmitted to the axel member 50. As will be recognized from a study of FIG. 4, in the second, deployed position 162, the respective outwardly facing peripheral edges 72, 100 and 130 of the respective article engaging portions 70, 90 and 120 define a substantially continuous and generally arcuately shaped surface 163. This surface may form a substantially logarithmic spiral. As presently illustrated in the drawings, the biasing member 150 which is borne on the second end 15 of the support member 11 forceably acts upon the individual portions 70 to move the individual portions from the first non-deployed position 161 to the second deployed position 162. As seen by reference to FIG. 3, in the first non-deployed position 161, the individual outwardly facing arcuately shaped peripheral edges 72, 100 and 130 of the respective portions 70, 90 and 120 are disposed in a position where they are discontinuous, one relative to the other. Still further, the inside peripheral edges 74, 103 and 133 are drawn into either a closely adjacent relation relative to the support member 11, or into overlapping relation relative to same such that the anchor assembly 10 can be easily inserted into a relatively narrow crack formed in a rock face, but later, under the influence of the biasing member 150, can be moved to a second deployed position 162 where it can resist a significant load applied to the second end 12 of the support member as when for example, a climber falls during a climb.

OPERATION

The operation of the described embodiment of the present invention is believed to be readily apparent and is briefly summarized at this point.

In one of its broadest aspects, the anchor assembly 10 of the present invention includes a support member 10 which is operable to be coupled to a load, and a camming lobe 60 is provided and which is rotatably mounted on the support member and which has a plurality of moveable portions 70, 90 and 120.

The anchor assembly 10 of the present invention is best understood by a study of FIGS. 4 and 5, respectively. As seen therein, the anchor assembly 10 includes a support member 11 having opposite first and second ends 12 and 15, respectively. A first article engaging portion 70 (FIG. 6) having a first end 80 is rotatably mounted on the second end of the support member. The first article engaging portion is operable for rotation in opposite first and second directions. A biasing member 150 is borne on the second end 15 of the support member 11 and forceably acts upon the first article engaging portion 70 to cause the first article engaging portion to rotate in the first direction. As seen in FIG. 4, the first direction is counterclockwise when seen in that view. A second article engaging portion 90 having a first end 94 (FIG. 7) is pivotally mounted to the second end 82 of the first article engaging portion 70. The second article engaging portion has a second end 95. A third article engaging portion 120 (FIG. 8) having a first end 124 is pivotally mounted to the second end of the second article engaging portion 90. The third article engaging portion has an opposite second end 125. A linkage 40 having opposite first and second ends 41 and 42 is provided. A force application assembly 30 slideably cooperates with the support member 11, and the first end 41 of the linkage 40 is affixed thereto. Still further, the second end 42 of the linkage is affixed to at least one of the article engaging portions 70, 90, and 120. As seen in the drawings, the linkage 40 is affixed to the third article engaging portion 120. In operation, the application of force by the climber's hand to the force application assembly 30 has the effect of moving the first, second and third article engaging portions 70, 90, and 120 along a course of travel between a deployed position 162 (FIG. 4), to a non-deployed position 161, which is seen most clearly in FIG. 5. Still further, and upon removal of the force applied to the force application assembly, the biasing member 150 exerts force on the first article engaging portion 70 to rotate the first article engaging portion in the first direction and to cause the first, second and third article engaging portions 70, 90 and 120 to assume a position such that they collectively form a substantially logarithmic spiral as shown in FIG. 4. As will be recognized by studying FIG. 4, and following, the force application assembly 30, linkage 40, and movement limiting areas 104 and 134 substantially restrains the respective article engaging members 90 and 120 from moving beyond the second deployed position when a force is applied to the first end 12 of the support member 11. Still further, the mating cooperation between the peripheral edges of the respective article engaging portions 74, 102 and 132 assures that force applied to the support member 11 is substantially uniformly transmitted to the axel member 50.

Therefore, the present invention provides a convenient means whereby an anchor assembly of the present invention can be utilized in a wide range of cracks having assorted shapes and dimensions not possible heretofore. As earlier discussed the prior art discloses various camming assemblies for use in cracks, however such camming assemblies have frequently been manufactured in various sizes to accommodate cracks of varying widths. In the present apparatus, the same anchor overcomes the limitations of the prior art by providing an anchor which can be utilized in a wide variety of cracks. Consequently, a climber utilizing this invention will need fewer of these anchor assemblies when attempting to complete a climb.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. An anchor assembly, comprising:

a support member having a first end, and an opposite second end;

a first article engaging portion having a first end which is rotatably mounted on the second end of the support member, and an opposite second end; and a second article engaging portion having a first end which is pivotally mounted on the second end of the first article engaging member and an opposite second end, and wherein the respective article engaging portions each have an outwardly facing, and an inwardly facing peripheral edge, and wherein the individual portions are moveable between a first position, wherein the individual outwardly facing peripheral edges of the individual portions define substantially discrete arcuately shaped surfaces, and the inwardly facing peripheral edges are disposed in spaced relation, one relative to the other, and a second position, wherein the outwardly facing portions of the individual portions together define a substantially continuous arcuately shaped surface, and the inwardly facing surfaces of the respective article engaging portions lie in juxtaposed force transmitting relation, one relative to another.

2. An anchor assembly as claimed in claim 1, and wherein in the second position the substantially arcuately shaped surfaces defined by the individual article engaging portions collectively define a substantially continuous arcuately shaped surface which forms a substantially logarithmic spiral.

3. An anchor assembly as claimed in claim 1, and further comprising:

a third article engaging portion having a first end which is rotatably mounted on the second end of the second article engaging portion, and which has an inwardly and an outwardly facing peripheral edge, and wherein the outwardly facing peripheral edge of the third article engaging portion forms a substantially continuous arcuately shaped surface along with the first and second article engaging portions when located in the second position.

4. An anchor assembly as claimed in claim 3, and further comprising:

a biasing member borne on the second end of the support member and which forcibly acts upon the first article engaging member to bias the first, second and third article engaging members in the direction of the second position.

5. An anchor assembly as claimed in claim 3, and wherein the respective first, second, and third article engaging portions have opposite sides, and wherein an axle is borne on the second end of the support member, and further defines an axis of rotation, and wherein the first article engaging portion has first, second and third apertures formed therein, and which extend between the opposite sides, and wherein the first aperture is formed in the first end thereof, and is operable to receive the axle therethrough, and wherein the second aperture is operable to receive and be forcibly engaged by the biasing member, and wherein the third aperture receives a first shaft, and wherein the inwardly facing peripheral edge of the first article engaging portion is undulating.

6. An anchor assembly as claimed in claim 5, and wherein the second article engaging portion has first and second apertures formed therein, and which extend between the opposite sides, and wherein the first aperture is formed in the first end of the second article engaging portion, and wherein the first aperture is operable to rotatably receive the first shaft which is borne on the second end of the first article engaging portion, and wherein a movement limiting area is formed in one of the sides of the second article engaging portion at the first end thereof, the movement limiting area limiting the rotational movement of the second article engaging portion relative to the first article engaging portion, and wherein the second aperture is formed in the second end of the second article engaging portion, and is operable to receive a second shaft, and wherein the inwardly facing peripheral edge of the second article engaging portion is undulating, and wherein the undulating inside peripheral edge of the second article engaging portion matingly cooperates with the undulating inside peripheral edge of the first article engaging portion when the respective article engaging portions are in the second position.

7. An anchor assembly as claimed in claim 6, and wherein the third article engaging portion has a first aperture formed therein and which extends between the opposite sides, and wherein the first aperture is formed in the first end of the third article engaging portion, and is operable to receive the second shaft which is borne on the second end of the second article engaging portion, and wherein a movement limiting area is formed in one of the sides of the third article engaging portion and at the first end thereof, the movement limiting area limiting the rotational movement of the third article engaging portion relative to the second article engaging portion, and wherein the inside peripheral edge of the third article engaging portion is undulating and further matingly cooperates with the undulating inside peripheral edge of the first article engaging portion when the respective article engaging portions are in the second position.

8. An anchor assembly as claimed in claim 7, and further comprising:

a force application assembly slideably borne by the support member; and a linkage having a first end mounted on the force application assembly, and an opposite second end which is affixed on the third article engagement portion, and wherein a force applied to the force application assembly is transmitted to the first, second, and third article engaging portions to move them from the second position in the direction of the first position, and wherein the release of the force applied to the force application assembly permits the biasing member to move the respective first, second and third article engaging portions from the first position in the direction of the second position.

9. An anchor assembly comprising:

a support member having opposite first and second ends;

an axle mounted on the second end of the support member and which extends substantially normally outwardly therefrom;

a first article engaging portion having a first end, and wherein the first end of the first article engaging portion is rotatably mounted on the axle, and rotates in a first, and an opposite, second direction;

a biasing member borne on the second end of the support member, and which forceably acts upon the first article engaging portion to cause the first article engaging portion to rotate in a first direction;

a second article engaging portion having a first end which is pivotally mounted to the second end of the first article engaging portion, and an opposite second end;

a third article engaging portion having a first end which is pivotally mounted to the second end of the second article engaging portion, and an opposite second end, and wherein an aperture is formed in the third article engaging portion;

a linkage having a first end which is affixed in the aperture formed in the third article engaging portion, and further having an opposite second end; and a force application assembly slideably cooperating with the support member, and wherein the second end of the linkage is mounted on the force application assembly, and wherein the application of force to the force application assembly has the effect of moving the first, second and third article engaging portions along a course of travel between a deployed position, to a non-deployed position, and wherein the application of force further causes the first article engaging portion to rotate in the second direction, and wherein the removal of the force applied to the force application assembly permits the biasing assembly to rotate the first article engaging portion in the first direction, and wherein the force application assembly is moveable along a course of travel between a first position, where the force application assembly and the linkage cause the respective article engaging members to move into the non-deployed position where the second and third article engaging members are disposed along, and in adjacent relation relative to, the support member, to a second position which permits the respective article engaging portions to move to the second deployed position, and wherein the force application assembly and linkage substantially restrains the respective article engaging members from moving beyond the second deployed position when a force is applied to the first end of the support member and wherein in the non-deployed position the anchor assembly has a first width dimension, and wherein in the deployed position the anchor assembly has a width dimension greater than the non-deployed position, and wherein each of the article engaging portions have an inside peripheral edge, and wherein the inside peripheral edges of the second and third article engaging portions matingly cooperate with the first article engaging portion when the respective article engaging portions are in the deployed position to transmit force applied to the first end of the support member substantially uniformly to the respective article engaging portions.

10. An anchor assembly as claimed in claim 9, and wherein the first, second and third article engaging members when located in the deployed position form a first segmented cam lobe, and wherein the anchor assembly further comprises a second segmented cam lobe which is rotatably mounted on the axle, and wherein the first and second segmented cam lobes are disposed in spaced relation, on relative to the other, and wherein the respective segmented cam lobes counter rotate one relative to the other, and wherein the biasing member is positioned between the respective segmented cam lobes and forcibly acts upon each to bias the respective segmented cam lobes into the deployed position.

11. An anchor assembly comprising:

a support member which is operable to be coupled to a load;

a camming lobe rotatably mounted on the support member, and which has first, second, and third article engaging portions, and wherein each of the article engaging portions have an inside peripheral edge;

a force application assembly slideably borne by the support member; and a linkage mounted on the force application assembly and coupled in force transmitting relation relative to the third article engaging portion, and wherein the application of force to the force application assembly causes the first, second, and third article engaging portions to move from a deployed position to a non-deployed position, and wherein in the non-deployed position each of the inside peripheral edges of the respective article engaging portions are disposed in spaced relation, one relative to the others, and wherein in the deployed position, the inside peripheral edges of the second and third article engaging portions lie in juxtaposed relation relative to the inside peripheral edge of the first article engaging portions.

12. An anchor assembly as claimed in claim 11, and wherein the first article engaging portion is rotatably mounted on the support member, the second article engaging portion is rotatably mounted to the first article engaging portion, and the third article engaging portion is rotatably mounted to the second article engaging portion.

13. An anchor assembly, comprising:

a support member having opposite first and second ends;

a first, second and third article engaging portion, and wherein each of the first, second and third article engaging portions have a first, and an opposite second end, and an inside peripheral edge, and wherein the first end of the first article engaging portion is rotatably mounted on the second end of the support member, and wherein the first end of the second article engaging portion is rotatably mounted on the second end of the first article engaging portion, and wherein the first end of the third article engaging portion is rotatably mounted on the second end of the second article engaging portion; and a linkage having a first end mounted on the third article engaging portion, and an opposite second end mounted on the support member, and wherein a force applied to the linkage is operable to move the respective first, second and third article engaging portions from a deployed position wherein the respective inside peripheral edges of the respective first, second and third article engaging portions are oriented in juxtaposed force transmitting relation one relative to another, to a non-deployed position wherein the respective inside peripheral edge of at least one of the first, second or third article engaging portions are moved out of force transmitting relation relative to the other article engaging portions.

* * * * *